United States Patent [19]

Ramer

[11] Patent Number: 4,794,746

[45] Date of Patent: Jan. 3, 1989

[54] JOIST BRIDGING

[76] Inventor: James L. Ramer, Rte. One, Box 50AA, Fortuna, Mo. 65034

[21] Appl. No.: 19,925

[22] Filed: Feb. 27, 1987

[51] Int. Cl.[4] ..... E04C 3/02

[52] U.S. Cl. ..... 52/695; 52/712

[58] Field of Search ..... 52/693, 695, 696, 713, 52/712, 317, 169.7, 635

[56] References Cited

U.S. PATENT DOCUMENTS

| | | | |
|---|---|---|---|
| 459,900 | 9/1891 | Moore | 52/695 |
| 682,086 | 9/1901 | Kearney | 52/695 |
| 866,140 | 9/1907 | Kahn | 52/695 |
| 1,204,956 | 11/1916 | Day | 52/695 |
| 1,509,011 | 9/1924 | Whiteside | 52/695 |
| 1,514,577 | 11/1924 | Burrell | 52/695 |
| 1,609,699 | 12/1926 | Coryell | 52/695 |
| 1,725,414 | 8/1929 | Parish | 52/695 |
| 1,729,741 | 10/1929 | Heltzel | 52/695 |
| 2,455,904 | 12/1948 | Meulenbergh | 52/695 |
| 2,623,246 | 12/1952 | Pestak | 52/695 X |
| 2,914,816 | 12/1959 | Lundgren | 52/695 X |
| 3,108,406 | 10/1963 | Ellis | 52/635 |
| 3,335,993 | 8/1967 | Tuttle | 52/696 X |
| 3,975,874 | 8/1976 | Witte et al. | 52/695 X |
| 4,109,324 | 8/1978 | Cornelius | 52/169.7 |
| 4,122,647 | 10/1978 | Kovar | 52/695 |

*Primary Examiner*—David A. Scherbel
*Assistant Examiner*—Richard E. Chilcot, Jr.
*Attorney, Agent, or Firm*—Senniger, Powers, Leavitt and Roedel

[57] ABSTRACT

A joist bridging component comprising a one-piece molded plastic member generally of X-shape having crossheads at the ends of the diagonals of the X adapted for being nailed facewise against joists and to act as gauges for establishing the joist spacing.

10 Claims, 1 Drawing Sheet

JOIST BRIDGING

BACKGROUND OF THE INVENTION

This invention relates to joist bridging, and more particularly to bridging for installation between wood floor joists in floor constructions.

Use of bridging between joists in floor construction is important for maintaining the load-bearing capacity of the joists and for transferring loads substantially uniformly throughout the floor system. In this regard, it will be understood that, without bridging, joists may tend to become inclined off vertical on their supporting structure (e.g. walls or beams) resulting in decrease in their load-bearing capacity and development of an undesirable springiness in the floor and an undesirable tendency for the floor to squeak. For some years, however, there has been a tendency in home construction to omit bridging because its installation is labor intensive and therefore relatively expensive.

One type of conventional bridging comprises pieces of lumber approximately 1"×3"×16" installed in pairs with the two pieces of each pair side-by-side in an X-pattern between two adjacent joists, each piece being nailed (usually by means of two nails) at its upper and lower ends to the joists. Another type comprises steel pieces which are similarly arranged and nailed in place, or which are formed with an integral nailing means for nailing to the joist at the upper ends of the pieces. A third type comprises pieces of lumber such as pieces of 2"×4" lumber or 2"×10" lumber cut to the correct length to fit between joists with respect to the center-to-center joist spacing (this spacing typically being 16"). This third type is expensive not only because of the required cutting to length, but also because it requires installation with a minimum of two nails at each end, which generally require relatively considerable time and effort to drive. Also, the nailing in place of one piece of bridging tends undesirably to cause separation of the previously nailed-in place piece from the joist.

With regard to the first and second types of conventional bridging as above described, the top ends of the bridge pieces must be nailed first before the flooring is applied, on account of the hammer clearance needed, for nailing. The lower ends are nailed after the flooring has been installed. This is difficult and time consuming even in the case of a house with a basement, and may be impossible in the case of a house without a basement. Home construction is more difficult in the typical situation where the flooring is constructed of 4'×8' pieces of plywood and where, heretofore, the general practice when using the conventional first type of bridging above mentioned has been to nail the upper ends of the bridging pieces first, then individually aligning the joists to conform to the plywood pieces so that the edges of two adjoining pieces of plywood bear on top of a joist, and then nailing the lower ends of the bridging pieces. The problem here is that flooring proceeds over joists that are unstable due to the bridge pieces not yet having been nailed at their lower ends, creating a dangerous working environment and the potential for exacerbating an already dimensionally imprecise placement of the joists.

SUMMARY OF THE INVENTION

Among the several objects of this invention may be noted the provision of joist bridging which renders bridging of joists economically viable, particularly for new construction, not only by reason of the provision of bridging members which are per se relatively economical to manufacture but which enable substantial reduction in the labor involved in placement of the joists; and the provision of such bridging which simplifies and reduces the time required for precisely centering the joists by acting as spacers for effecting precise centering of the joists, without interfering with the laying of the flooring on the joists.

In general, a joist bridging component of this invention comprises a member generally of X-shape having a horizontal axis and a vertical axis and being generally symmetrical about the horizontal axis and generally symmetrical about the vertical axis. This X-shaped member has a plate portion at the center of the X generally in the plane of the X, first and second arms radiating from the center plate portion on one side of the horizontal axis and third and fourth arms radiating from the center plate portion on the other side of the horizontal axis. The first and second arms are generally symmetrical with the third and fourth arms about the horizontal axis and the first and third arms are generally symmetrical with the second and fourth arms about the vertical axis. Each arm has a web generally of the same thickness as the center plate portion and coplanar with the center plate portion and with each other, and a flange along the outside edge of the web. The center plate portion has a first flange at the edge thereof on the said one side of the horizontal axis continuous with the flanges of the first and second arms and a second flange at the edge thereof on the said other side of the horizontal axis continuous with the flanges of the third and fourth arms. The first and third arms at their outer ends have heads having outside faces in a first plane generally perpendicular to the horizontal axis for facewise engagement with a side of a joist and adapted to be nailed to a joist, and the second and fourth arms at their outer ends have heads having outside faces in a second plane perpendicular to the horizontal axis adapted for facewise engagement by the next joist to be set in place and adapted to be nailed to said next joist and spaced from said first plane a distance for establishing the joist spacing.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 1:
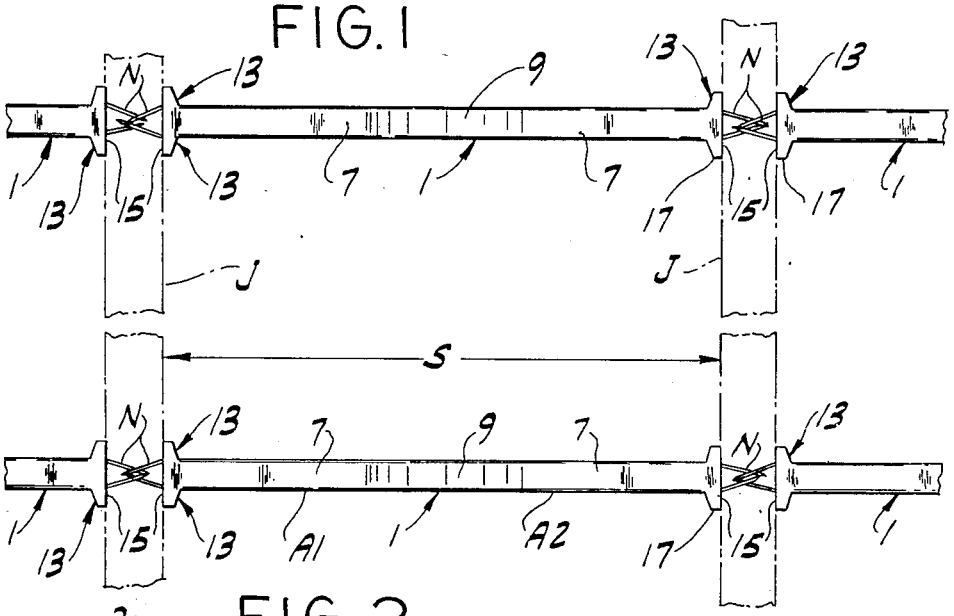
FIG. 1 is a plan of flooring including joist bridging members of this invention, the joists being shown in phantom also broken away.

Referring to the drawings, a joist bridging component of this invention, designated in its entirety by the reference numeral 1, is shown to comprise a member generally of X-shape having a horizontal axis H and a vertical axis V and being generally symmetrical about the horizontal axis and generally symmetrical about the vertical axis, The member 1 has a plate portion 3 at the center of the X generally in the plane of the X, first and second arms A1 and A2 radiating from the center plate portion 3 on one side of the horizontal axis and third and fourth arms A3 and A4 radiating from the center plate portion on the other side of the horizontal axis. The first and second arms A1 and A2 are generally symmetrical with the third and fourth arms A3 and A4 about the horizontal axis H and the first and third arms A1 and A3 are generally symmetrical with the second and fourth arms A2 and A4 about the vertical axis V. Each arm has a web 5 generally of the same thickness as the center plate portion 3 and coplanar with the center plate portion and with each other, and a flange 7 along the outside edge of the web. The center plate portion 3 has a first flange 9 at the edge thereof on the said one side of the horizontal axis H continuous with the flanges 7 of the first and second arms A1 and A2 and a second flange 11 at the edge thereof on the said other side of the horizontal axis H continuous with the flanges 7 of the third and fourth arms A3 and A4. The first and third arms A1 and A3 at their outer ends have heads 13 having outside faces 15 in a first plane generally perpendicular to the horizontal axis H for facewise engagement with a side of a joist J and adapted to be nailed to a joist. The second and fourth arms A2 and A4 at their outer ends have similar heads 13 in a second plane perpendicular to the horizontal axis H adapted for facewise engagement by the next joist to be set in place and adapted to be nailed to said next joist J and spaced from said first plane a distance S for establishing the joist spacing.

Figure 5:
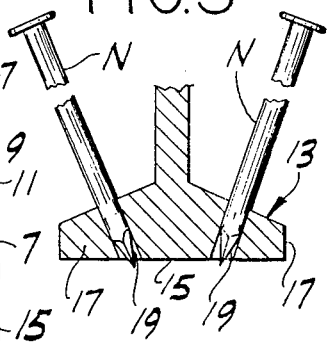
FIG. 5 is an enlarged section on line 5—5 of FIG. 3.

The member 1 is preferably a one-piece molded plastic member, injection molded of a suitable plastic, more particularly a high impact and creep resistant plastic having the requisite rigidity. The flanges 7, 9, 11 extend lateally outwardly at both sides of the arms A1–A4 and the central plate portion 3. The heads 13 are in the nature of crossheads at the ends of the arms having side portions 17 extending lateally outwardly at both sides of the arms, these portions being of decreasing thickness laterally outwardly from the arms as shown in FIG. 5 to allow for nailing clearance. These side portions 17 of the crossheads 13 are molded with nail holes 19 therein, two such holes being shown in each said portion, these holes receiving the nails N for nailing the member in place. The nails, which may be 16d joist hanger nails, for example, may be preset in the nail holes 19 in member 1 as supplied to reduce the installation time. The nail holes may be angled off 90° relative to face 15 of the head, as shown in FIG. 5, and may be of such diameter as to provide for a press fit of the nails therein.

Figure 2:
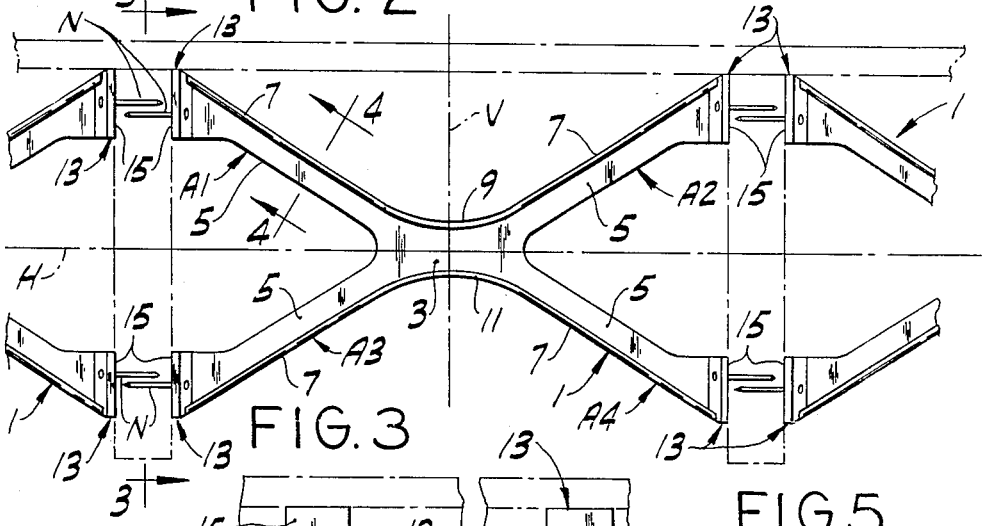
FIG. 2 is a view in side elevation of FIG. 1, the joists again being shown in phantom, the floor laid on the joists also being shown in phantom.
Figure 3:
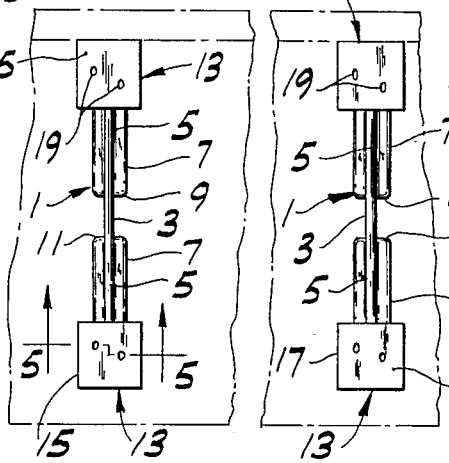
FIG. 3 is a view on line 3—3 of FIG. 2, showing one end of a bridging member.
Figure 4:
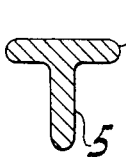
FIG. 4 is an enlarged section on line 4—4 of FIG. 2.

In the installation of joists J for flooring, utilizing the joist bridging component or members 1, the first joist of the flooring is set in place, e.g. one end on a sill member on the foundation wall and the other on a beam. The carpenter affixes one or more members 1 (the number depending on the desired or code-required spacing for the bridging members) to the face of this first joist which faces the second joist to be applied by abutting the faces 15 of the crossheads 13 at the ends of arms A2 and A4, for example, of the member 1 against the face of the joist and driving in the preset nails, thus firmly securing the members to the first joist. The second joist is then set in place with its face toward the first joist abutting the faces 15 of the crossheads 13 on the other arms A1 and A3 of the member or members 1 and drives the nails N preset in the latter crossheads into the second joist, thus firmly securing the member or members 1 to the second joist. Then, a second member or second set of members 1 is nailed to the other face of the second joist in the same manner as the first set was nailed to the first joist, the third joist is set in place against the second member or second set of members in the same manner as the second joist was set in place, and the second member is nailed (or the members of the second set are nailed) to the third joist in the same manner as the member or members of the first set were nailed to the second joist. This procedure is repeated for the remainder of the joists making up the flooring. The floor applied to the joists is generally indicated at F in FIG. 2. The bridging members 1 may be lined up in a row or rows, as shown in FIG. 1, or the bridging members may be offset on opposite sides of a joist. It will be observed that the members 1 are such as to be capable of being lined up in a row.

With the nails N preset in the nail holes 19 in the crossheads 13 of the bridging members 1, a set of the members may be quickly and readily applied and, as applied, serves in effect as a gauge for setting the next joist in place accurately centered on centers established by the spacing S of the faces 15 on crossheads 13 on arms A1 and A3 and the faces 15 on crossheads 13 on arms A2 and A4. For the typical 16″ desired joist spacing, with joists having the usual standard thickness of 1.50″, this spacing S is 14.50″. For smaller joist spacing as is at times used for the spacing of the first joist at one end of a house and the next joist, the spacing S is correspondingly smaller. Thus, for example, the first set of members 1 may comprise members as to which S is 13.75″, and the successive sets may comprise members as to which S is the aforesaid 14.50″. It is to be understood that a "set" may comprise only one bridging member.

With the bridging members 1 extending between adjacent joists J and nailed thereto by the nails N, shear on the nails driven through each upper crosshead 13 due to load on the respective joist is transferred to the adjacent joist through the diagonal of the X, e.g. the diagonal comprising arms A1, A4, extending diagonally down to the adjacent joist and the crosshead 13 and nails N at the lower end of that diagonal, with the latter in compression and shear on the nails driven through each lower crosshead 13 due to load on the respective joist is transferred to the adjacent joist through the diagonal of the X, e.g. the diagonal comprising arms A3, A2 extending diagonally up to the adjacent joist and the crosshead 13 and nails N at the upper end of said diagonal, with the latter in tension. The bridging members 1 act to restrain the joists from tilting or canting off vertical and maintain generally the full load-bearing capacity of the joists. In this regard, tilting or canting is restrained by the diagonals of members 1 acting in compression and tension similarly to their action in compression and tension for transferring shear as above described. With the flanges 7 on the arms A1–A4, and the flanges at 9 and 11, the diagonals are relatively strong in compression as well as in tension.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A floor comprising joists extending in spaced side-by-side relation and a bridging system therefore comprising joist bridging components between adjacent joists, each joist bridging component comprising a one-piece member generally of X-shape having a horizontal axis and a vertical axis and being generally symmetrical about the horizontal axis and generally symmetrical about the vertical axis, said member having a plate portion at the center of the X generally in the plane of the X, first and second arms integral with said center plate portion radiating from the center plate portion on one side of the horizontal axis and third and fourth arms integral with said center plate portion radiating from the center plate portion on the other side of the horizontal axis, the first and second arms being generally symmetrical with the third and fourth arms about the horizontal axis and the first and third arms being generally symmetrical with the second and fourth arms about the vertical axis, each arm having a web generally of the same thickness as the center plate portion and coplanar with the center plate portion and said webs being coplanar with each other, each arm having a flange along the outside edge of the web, the center plate portion having a first flange at the edge thereof on the said one side of the horizontal axis continuous with the flanges of the first and second arms and a second flange at the edge thereof on the said other side of the horizontal axis continuous with the flanges of the third and fourth arms, the first and third arms having at their outer ends integral heads having outside faces in a first plane generally perpendicular to the horizontal axis in facewise engagement with a side of a joist and nailed thereto, and the second and fourth arms having at their outer ends integral heads having outside faces in a second plane perpendicular to the horizontal axis in facewise engagement with a side of the adjacent joist and nailed adjacent joist, said planes being spaced a fixed distance for establishing the joist spacing.

2. A floor as set forth in claim 1 wherein the flanges of each said bridging component extend laterally outwardly at both sides of the arms and the central plate portion.

3. A floor as set forth in claim 1 wherein the head of each said bridging component have nail holes therein.

4. A floor as set forth in claim 3 wherein each said bridging component is supplied with nails preset in the nail holes for driving into the joists.

5. A floor as set forth in claim 2 wherein the heads of each said bridging component are crossheads at the ends of the arms.

6. A floor as set forth in claim 3 wherein the crossheads of each said bridging component have side portions of decreasing thickness laterally outwardly from the arms.

7. A floor as set forth in claim 6 wherein the side portions of the crossheads have nail holes therein.

8. A floor as set forth in claim 7 wherein each said bridging component is supplied with nails preset in the nail holes in the side portions of the crossheads for driving into the joists.

9. A floor as set forth in claim 1 wherein each said bridging component is molded in one piece of plastic, the heads being crossheads at the ends of the arms, the crossheads having side portions with nail holes therein.

10. A floor as set forth in claim 9 wherein the side portions of the crossheads are of deceasing thickness laterally outwardly from the arms, the nail holes are angled off 90° to the outside faces of the crossheads, and the nails are preset in the holes.

* * * * *